United States Patent [19]

Cusey et al.

[11] Patent Number: 4,542,383

[45] Date of Patent: Sep. 17, 1985

[54] REPLACEABLE MOTOR OPERATED ANTENNA

[75] Inventors: Dar L. Cusey; John M. Kinard, both of Montgomery, Ala.

[73] Assignee: National Industries, Inc., Montgomery, Ala.

[21] Appl. No.: 496,897

[22] Filed: May 23, 1983

[51] Int. Cl.[4] ..... H01Q 1/10

[52] U.S. Cl. ..... 343/903

[58] Field of Search ..... 343/889, 903, 901

[56] References Cited

U.S. PATENT DOCUMENTS

| | | | |
|---|---|---|---|
| 2,635,186 | 4/1953 | Schmidt | 343/889 |
| 3,380,062 | 4/1968 | George | 343/903 |
| 4,209,792 | 6/1980 | Carolus et al. | 343/903 |
| 4,325,069 | 4/1982 | Hills | 343/903 |

FOREIGN PATENT DOCUMENTS 1435493 5/1976 United Kingdom .

*Primary Examiner*—Eli Lieberman

*Attorney, Agent, or Firm*—Watts, Hoffmann, Fisher & Heinke Co.

[57] ABSTRACT

A motor operated antenna for an automobile. The antenna includes a number of telescoping collapsible sections which form a removable unit. A reversible electric motor is mounted next to a fixed antenna tube in which the unit is positioned. The motor raises and lowers the sections in response to a switch actuated by a user. In the event any of the sections comprising the unit are bent or broken a collar holding the unit in place in the tube is loosened and removed. The unit can be withdrawn from the tube and replaced with a new unit.

10 Claims, 10 Drawing Figures

REPLACEABLE MOTOR OPERATED ANTENNA

DESCRIPTION

1. Technical Field

This invention relates to a replaceable, collapsible, motor operated, (so-called "electric") antenna, especially for automotive use.

2. Background Art

Collapsible antennas raised and lowered by electric motors are commonly used on automobiles. Such antennas are typically mounted in a fender well as is a battery powered motor for raising and lowering the antenna into and out of operative position. The collapsible motor operated antenna can be original equipment or can be an after market automobile accessory installed by the automobile owner.

A motor operated antenna must be rugged and powerful enough to function under the adverse conditions of vibration, snow, ice and the like, and be of a low cost yet reliable design. It is also important that excess water seepage to the underside of the fender through the antenna be avoided. This seepage can damage components which raise and lower the antenna necessitating early replacement of those components.

While the retracting feature of the motor driven antenna reduces the likelihood of breaking or bending the antenna, even the power driven antenna is occasionally damaged. With a conventional non-powered antenna, replacement is a fairly simple task. With the power driven antenna, however, replacement has typically required replacement of the entire unit at a much greater cost than replacing a non-powered antenna.

DISCLOSURE OF THE INVENTION

The present invention features a motor-operated antenna that is easy to install and that can be partially disassembled to enable bent or broken antenna sections to be replaced. Since the replaceable antenna sections cost only a fraction of the price for the entire antenna unit, this feature makes the motor-driven antenna a more desirable accessory to the car owner.

The disclosed antenna structure includes an outer fixed tube that forms a base antenna section, and a number of telescoping antenna sections collapsible inside this outer tube. The collapsible telescoping sections form a removable antenna unit. The removable collapsible sections are retracted and extended by a reversible electric motor having an output shaft coupled to those sections by a transmission. The electric motor and transmission are supported in a housing, which is fixed in relation to the outer tube.

The antenna structure further includes a collar on the outer tube for limiting the extent of movement of the telescoping antenna sections. The collar is removable so the telescoping sections can be withdrawn from the outer tube and replaced as a unit without having to replace the entire antenna apparatus. Thus, in the event the telescoping sections are either bent or broken, they can be easily replaced without the expense and loss that would otherwise result from removing and replacing the motor, housing and related support structure.

In accordance with the preferred embodiment of the invention, an end of the outer tube, including the removable collar, extends through an opening in an antenna mounting surface, such as a body panel in an automobile. To replace the inner core member, the collar is removed and the telescoping sections are pulled from the outer tube and replaced with a new unit.

The transmission for extending and retracting the antenna sections comprises a flexible threaded core secured to the innermost telescoping antenna section, a belt and pulley driven rotatable drive nut, and an electric motor that extends and retracts the antenna sections, depending upon the direction of motor rotation.

A plastic insulating sleeve constructed to inhibit rotation of the flexible cord is separate from the transmission housing, which allows the sleeve to be replaced in the event contact with the cord causes excessive wear.

A seal prevents water from flowing along the antenna to the region of the drive nut and other transmission parts. In a preferred embodiment this seal is an O-ring that surrounds the flexible cord and is axially compressed at the base of the outer tube when the outer support tube is installed.

During installation, the outer tube and insulator are inserted into a cylindrical cavity in the transmission housing. The flexible cord attached to the replacement unit is then inserted into a through passage in the insulator and the motor energized so that the threaded portions of the cord engage the threaded portions of the pulley driven drive nut. The cord threads through the nut until the collapsible sections of the removable antenna unit is completely drawn into the outer fixed tube. The retaining collar is then securely tightened onto the outer tube until its threads bottom out.

The antenna sections, including the tube, are then manually pressed toward the transmission housing until an external shoulder or flange of the collar contacts an upper end of an insulator that is fixed in relation to and extends above the mounting surface. As the antenna sections are pressed into position, they compress the O-ring. Fasteners are then inserted through the transmission housing into the plastic sleeve to rigidly position the sleeve and outer tube at the desired location with respect to the housing so the collar flange is tightly against the fixed upper insulator. In the event one or more antenna sections are damaged, the retaining collar can be removed, allowing replacement of the antenna sections without moving the outer tube.

From the above it will be appreciated that one object of the present invention is the provision of an attractive motor-operated antenna that facilitates replacement of telescoping antenna sections apart from the supporting and driving mechanisms, and that is resistant to damage due to water seepage throughout the antenna structure. This and other objects and advantages of the invention will become better understood from the detailed description of a preferred embodiment of the invention that is described in conjunction with the accompanying drawings.

BEST MODE FOR CARRYING OUT THE INVENTION

Figure 1:
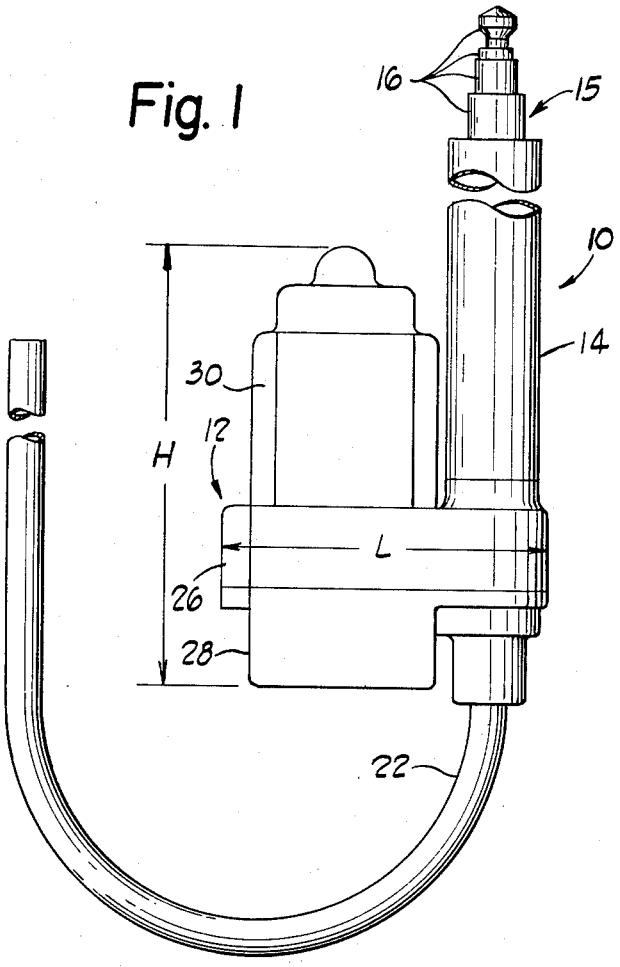
FIG. 1 is a side elevational view of an antenna assembly embodying the present invention.
Figure 2:
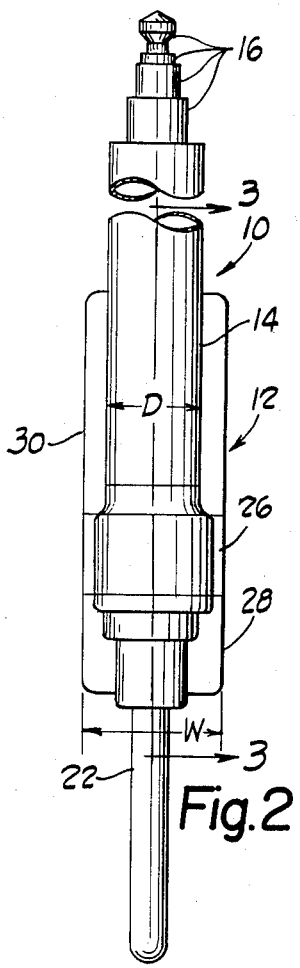
FIG. 2 is an end elevational view of the antenna of FIG. 1.
Figure 3:
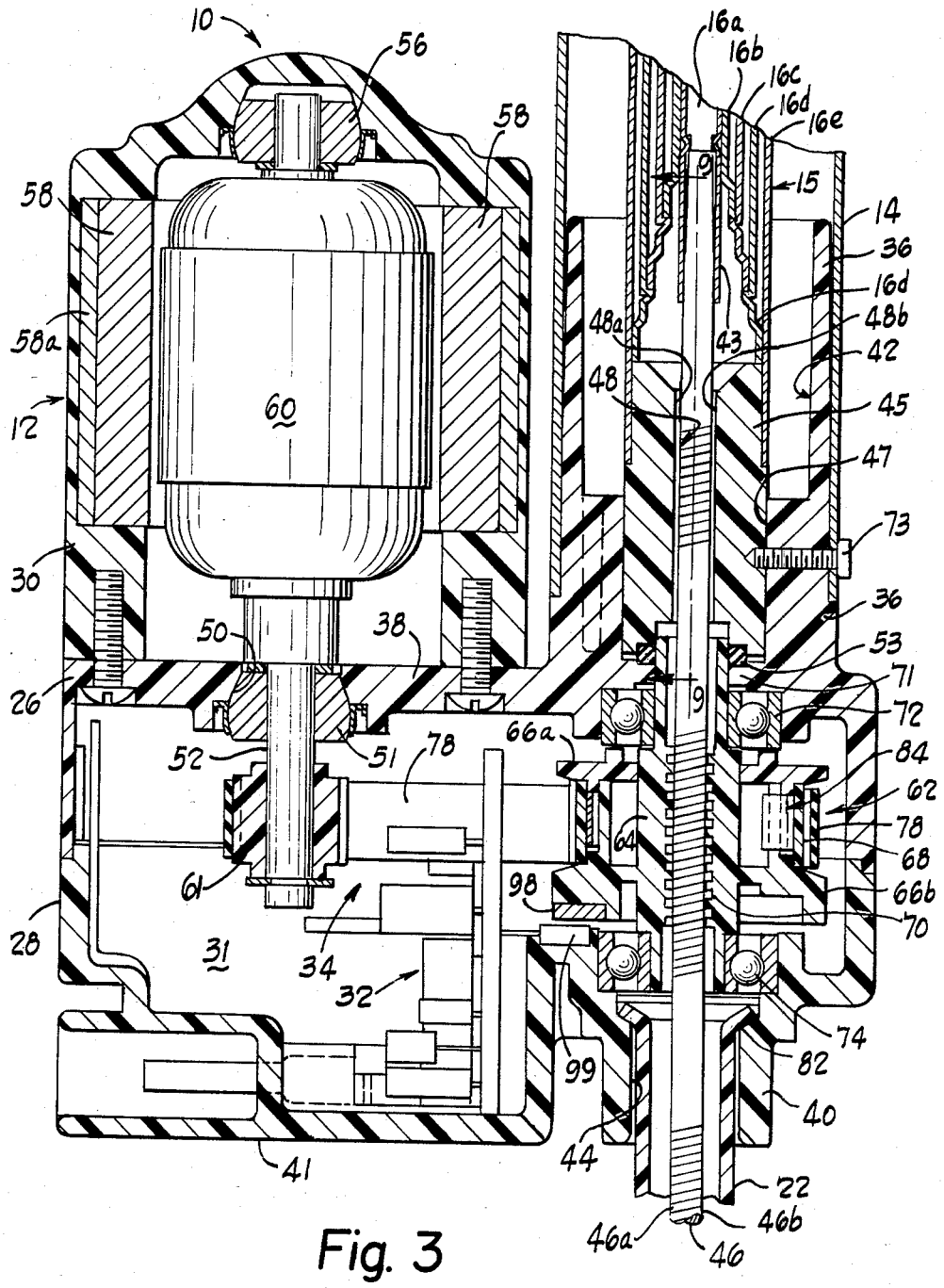
FIG. 3 is a partial sectional view of the antenna of FIGS. 1 and 2, taken along the line 3—3.

An antenna assembly 10 embodying the invention is shown in FIGS. 1-3, comprising a housing 12 for a motor and drive transmission, a supporting tube 14 for supporting the assembly and for housing a collapsible antenna mast 15 comprised of telescoping sections 16, and a flexible storage tube 22 for a flexible cord that extends and retracts the telescoping sections 16*a–d*. As FIGS. 1 and 2 show, the housing 12 is elongated and very little wider than the supporting tube 14. The assembly is very compact and can be mounted within a small space.

As best shown in FIG. 3, the housing 12 is formed of three injection molded plastic pieces 26, 28, 30, that interfit to form a strong enclosure. Pieces 26, 28 together form a cavity 31 for a printed circuit board and switch assembly 32 and a drive transmission 34. The housing piece 26 has a cylindrical boss 36 projecting perpendicularly from a top wall 38 to connect with the supporting tube 14. The housing piece 28 has a cylindrical boss 40 extending perpendicular to a bottom wall 41, aligned with the boss 36, and accommodating connection of the flexible storage tube 22 with the housing.

A central opening 42 extends through the boss 36 and a central opening 44 extends through the boss 40, each axially aligned with the other, to accommodate passage of a flexible cord 46 through the housing. Beyond the boss 36, the cord is connected to a center antenna section 16*a* by a coupling tube 43 which is crimped about the cord 46 and center section 16*a*. Beyond the boss 40, the cord 46 extends into the storage tube 22.

The cord is of plastic, such as Delrin, and is externally threaded on two diametrically opposite portions. The cord has two diametrically opposite flat outer surfaces 46*a*, 46*b* along its length, resulting in peripherally broken threads. The cord passes through a central opening 48 of a tubular plastic insulator 45 within the boss 36, the insulator being cylindrical and slidably received within a cylindrical wall 47 within the boss 36. The insulator is partially received within a base of the fixed antenna tube 16 *e* and the two are secured together, as by crimping or otherwise, deforming a part of the tube into the insulator. Two opposed flat surfaces 48*a*, 48*b* of the plastic insulator prevent rotation of the cord 46 relative to the housing, yet provide sufficient clearance to allow free sliding of the cord. Because the inside passage 48 is subject to wear from the movement of the cord 46 it is made long relative to its diameter (several times as long) and is replaceable within the housing.

Figure 9:
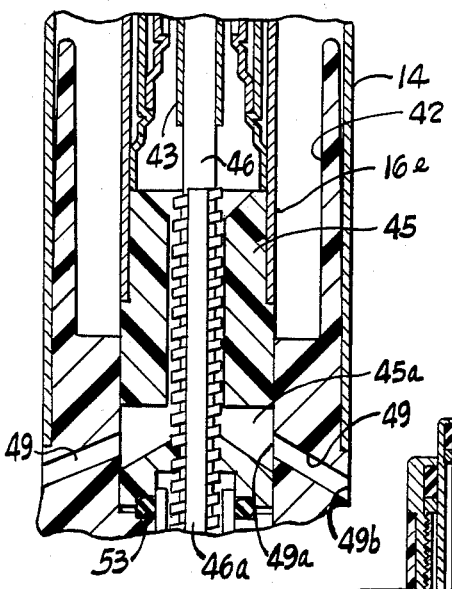
FIG. 9 is a sectional view showing a bottom of the antenna coupled to a plastic insulator which defines a passageway through which water flows away from the antenna drive to an exterior of the antenna assembly.

To avoid risk of malfunctioning of the antenna drive from exposure to water that may find its way into the housing along or near the antenna mast, and which in cold weather can freeze and prevent relative movement between parts of the tubular drive transmission, two passages 49 (FIG. 9) are provided in the boss 36. The passages open at one end 49*a* in communication with drains 45*a*, 45*b* in the tubular insulator 45 and at the other end 49*b* at the exterior of the housing below the supporting tube 14, and are inclined downwardly and outwardly. The drains 45*a*, 45*b* are located above an O-ring seal 53 at the base of the insulator 45, between the insulator and the housing wall 38. Water leaking along the antenna 15 mast is intercepted before reaching the seal 53 and carried away through the less restrictive drains 45*a*, 45*b* and passages 49 to the outside of the housing. Also, water that may find its way between the telescoping antenna sections will tend to be flung from the cord 46 as it is rotated and will be received by the drains 45*a*, 45*b*. The seal 53 blocks the flow of any water that might happen to seep past the drains 45*a*, 45*b*.

Figure 6A:
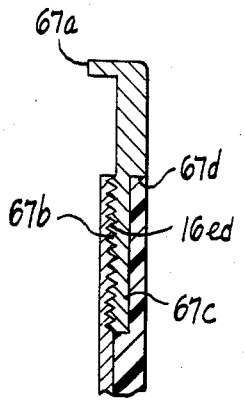
FIG. 6A is an enlarged sectional view showing details of a retaining collar which can be removed to allow a replaceable antenna unit to be replaced.
Figure 6:
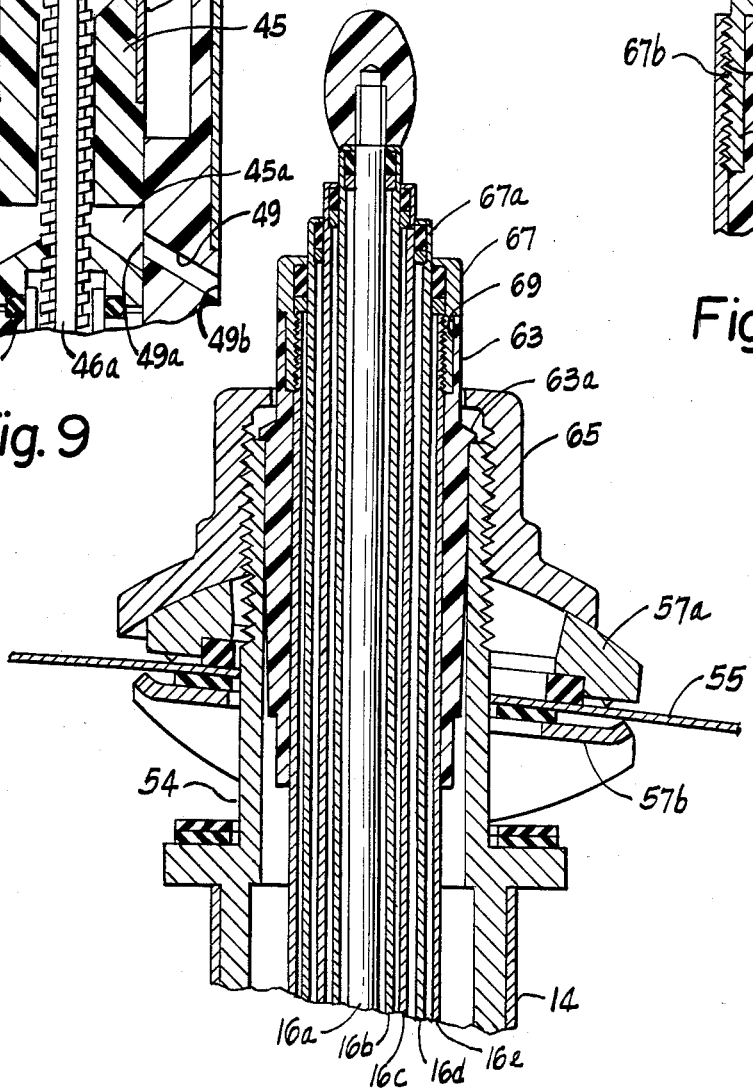
FIG. 6 is a partial sectional view of the antenna of FIGS. 1 and 2 showing the antenna supported by a mounting surface.

An upper end of the support tube 14 is securely fastened by brazing or welding to a metal mounting member 54, which extends through an opening in a mounting sheet 55 such as an automobile fender or the like (FIG. 6). Top 57*a* and bottom 57*b* mounting brackets orient the antenna sections 16*a–e* at any desired angle with respect to the sheet 55 so that the antenna rises in the desired direction when it is extended.

A tubular plastic insulator 63 fits closely around the upper end of the outer fixed antenna tube 16*d* and includes a circular external shoulder 63*a*, which rests against an upper end of the mounting member 54. With the insulator 63 in place, a retaining nut 65 having an inner threaded portion is tightened down over an outer threaded portion of the mounting member 54 until the brackets 57*a*, 57*b* and mounting member 54 are securely mounted to the sheet 55.

The antenna sections 16*a–d* are replaceable so that if any are broken or bent an entire unit of those sections 16*a–d* may be removed and replaced. The outer section 16*d* is retained within the fixed antenna tube 16*e* by a retaining collar 67 that has a central opening 67*a* closely surrounding the section 16*d* which is too small to allow the enlarged base portion 16*d* (FIG. 3) to pass through. The collar 67 has an internal thread 67*b* that engages a threaded exterior portion 16*ed* at the extending end of the fixed antenna tube 16*e*. When the collar 67 is securely fastened to the outer tube 16*e*, a reduced diameter portion 67*c* telescopes into a cylindrical recess 69 formed between the end of the outer tube 16*e* and the insulator 63. A circumferential flange 67*d* abuts the end of the insulator 63.

The housing piece 26 (FIG. 3) has an opening 50 in the top wall 38, in which a spherical bearing 51 is located that rotationally supports an armature shaft 52 of a motor 60 along an axis that is parallel to the longitudinal extent of the antenna mast 15.

The housing piece 30 is a generally cylindrical, cup-like, member that carries a spherical bearing 56 at an upper end, in which the armature shaft 52 is journalled. It also carries permanent motor field magnets 58 which are bounded by an iron shield 58*a* that protects the magnets 58 from exposure to extremely low temperatures which can reduce the intensity of the magnetic field they create.

The drive transmission 34 has a drive pulley 61 in the cavity 31, secured to the end of the motor shaft 52, which extends through the top wall 38 into the cavity 31. A driven pulley 62 is supported laterally to one side of the drive pulley 61, between two bearings 72, 74. The bearing 72 is secured in the housing piece 26 and the bearing 74 in the housing piece 28, each adjacent a respective boss 36 40, mounting the pulley 62 in axial alignment with the central openings 42, 44 that together form a through passage.

The driven pulley 62 is of a two piece construction. A hub portion 64 (FIGS. 3 and 7) has top and bottom flanges 66*a*, 66*b* that rotatably support a sleeve 68 having gear teeth about its periphery. The hub 64 has a central through passage with internal threads 70 that engage the threads of the cord 46 and acts as a rotary nut to drive the cord. A timing belt 78 driven by the pulley 61 engages the teeth on the sleeve 68 which rotates the hub 64 through an overrunning clutch 84. The clutch 84 is interposed between the sleeve 68 and hub 64 so that rotation from the sleeve to the hub is transmitted through the clutch 84.

The threaded relationship of the hub 64 and the cord 46 results in the longitudinal movement of the cord 46 upon rotation of the hub 64, which is restrained from axial movement by the bearings 72, 74. Thus, rotation of the hub through the transmission 34 drives the cord in a direction to extend the antenna sections or retract them, depending upon the direction of motor rotation. Because the pulley 61 is substantially smaller in diameter than the pulley 62, a speed reduction and power increase result.

Figure 7:
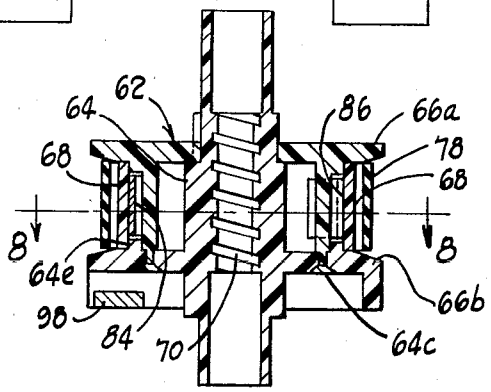
FIG. 7 is a partial sectional view of an antenna drive showing details of the construction of that drive.

As best shown in FIG. 7, the flange 66*b* is integral with the hub 64. The flange 66*a* is keyed to the hub and secured to the flange 66*b* by extensions 66*c* that extend into holes in the flange 66*b* and are heat welded in place.

The clutch 84 automatically decreases the force by which the hub and sleeve are interengaged when the antenna reaches the end of its travel during extension or retraction. The clutch overruns smoothly and without generation of excessive heat. This is accomplished by the use of a spring strip wrapped in a ring-like shape within an inside cylindrical surface 86 of the sleeve 68. The resilience of the spring strip causes it to engage the inside cylindrical surface 86 with sufficient force to frictionally rotate with the driven pulley under the loads experienced during extending and retracting the antenna sections when the sections are not obstructed.

Figure 8:
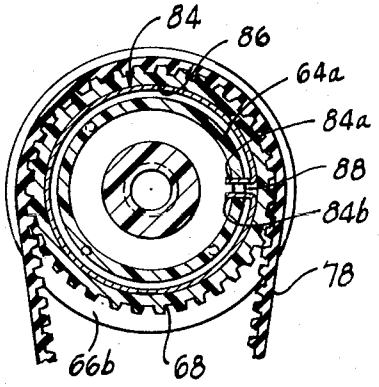
FIG. 8 is a sectional view taken along the line 8—8 of FIG. 7.

The spring strip encircles the hub 64 and has an inturned flange at 84*a*, 84*b* at each opposite end, received in a notch 88 in the hub 64. The notch is sufficiently large circumferentially to allow some peripheral movement of the ends of the spring, which are spaced from each other peripherally a short distance, as best illustrated in FIG. 8. As illustrated in FIGS. 7 and 8, the spring surrounds the outside diameter of the adjacent nut portion with radial clearance. Rotation of the sleeve, transmitted to the spring through friction, causes rotation of the hub by contact of one of the flanges 84*a*, 84*b* of the spring with an end of the receiving notch 88.

When rotation of the hub is stopped, as at the end of antenna travel, the frictional force of the sleeve 68 on the spring causes the spring to rotate slightly. This moves a free end of the spring toward the opposite end, reducing the diameter of the spring and relieving the frictional force against the inside diameter of the sleeve. This allows the sleeve to be rotated more freely by reduction of the frictional force between the spring and pulley, and thereby reduces the load on the motor and the generation of heat through the relative sliding. As will be apparent from FIG. 8, the spring functions identically in either direction of rotation of the driven pulley.

As shown in FIG. 3, the upper boss 36 receives the supporting tube 14 in closely surrounding relation. The mast is secured to and supported by the insulator 45, which compresses the O-ring seal 53. During installation of the antenna, the mast 15 and attached cord 46 is inserted into the tube 14 so the cord 46 can be inserted into the opening in the hub 64. When the mast 15 is inserted, the insulator 45 is oriented so its drains 45*a*, 45*b* communicate with the passageways 49 (FIG. 9) which, in a preferred embodiment, leads away from the threads on the cord 46 to the exterior of the housing 26. The motor 60 is energized in a direction to draw the cord 46 into the hub 64 until the mast approaches the position shown in FIG. 3, i.e. where the retaining nut 67 screwed to the outer mast section 16*e* begins to seat in the recess 69 in the top insulator 63 (FIG. 6). At this time a bottom end of the insulator 45 begins to compress or at least contact the O-ring seal 53.

The mast 15 is inserted a slight distance further until the collar 67 completely seats in the recess 69, with the flange 67*d* abutting the end of the insulator 63. This additional movement is accomplished by compressing the O-ring seal between the insulator 45 and a restricted region 71 of the housing member 26 through which the hub portion of the driven pulley 62 fits. Once the mast is properly seated in place, threaded connectors 73 with pointed ends are screwed through the tube 14 and boss 36, into the insulator 45 securely positioning the mast 15 in place. In a preferred embodiment three connectors 73 are used. In the event of damage to the core sections 16*a–d* those sections may be replaced as outlined above without removing the outermost section 16*e* which is fastened to the insulator 45.

The storage tube 22 for housing the cord 46 fits inside the boss 40. The tube has a shoulder 82 on the end to retain it within the housing. The storage tube 22, being flexible, can be bent to whatever contour desired, depending upon the wheel well shape and construction in which the assembly is mounted, to provide an enclosure for the cord 46 when the antenna mast is collapsed. Alternatively, it can be preformed to a desired contour.

Figure 4:
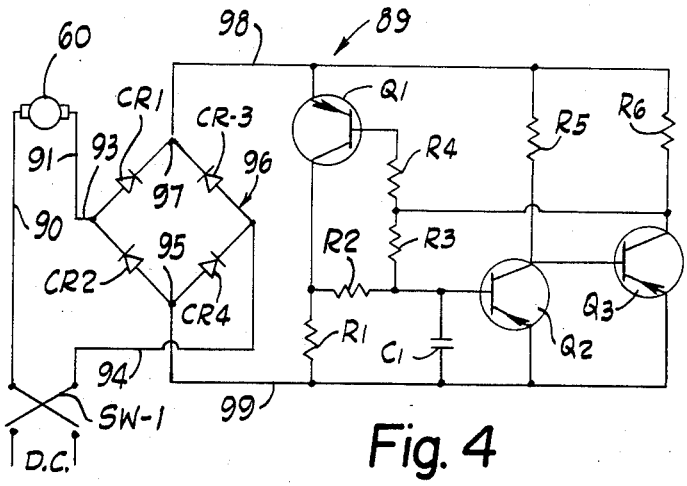
FIG. 4 is a schematic diagram of a control circuit for operating the motor of the antenna shown in FIGS. 1–3.

A schematic wiring diagram of the switch assembly 32 located within the housing piece 28 is shown in FIG. 4. As shown, power from a battery such as an automobile battery is supplied to the DC motor 60 through lines 90, 91. The direction of the motor is controlled by the polarity of the current applied through the leads, which can be changed through a double pole, double throw, center off toggle switch SW1 mounted to an automobile dashboard.

A switching circuit 89 is interposed in the lead 91 by two connecting leads 93, 94. Both leads 93, 94 connect to a rectifying bridge type circuit 96 from which two lines 98, 99 of the switching circuit are connected. The bridge circuit 96 maintains a first junction 95 negative and a second junction 97 positive regardless of the polarity of the switch SW1 to allow the switching circuit to operate regardless of a change of polarity at the connections 93, 94 when current to the motor 60 is reversed.

The switch circuit 89 removes the power from the motor when a preset time and current load conditions have been met, such as a short time after the motor reaches the end of its travel and a greatly increased load and hence current demand is placed upon the motor 60.

The circuit 89 of FIG. 4 includes diodes CR1, CR2, CR3 and CR4, three transistor Q1, Q2 and Q3, a capacitor C1 and resistors R1=1k, R2=10k, R3=10k, R4=10k, R5=1k and R6=1 ohm, all connected as shown to conduct current to the motor 60 until a predetermined current load is applied for a predetermined time.

When the switch SW1 first couples the battery to the motor 60 to drive the antenna up or down the NPN power transistor Q3 conducts in a saturated state so the car battery drives the motor 60 through the 1 ohm resistor R6. Q1 is turned off since the voltage across the one ohm resistor R6 is too small to bias that transistor into conduction. When the motor experiences a greater load as it drives the antenna to an end of travel, the current through the motor will increase causing the voltage across the resistor R6 to rise to the point where the transistor Q1 turns on. This turn on causes the capacitor C1 to charge with a R2C1 time constant until Q2 turns on. When the transistor Q2 turns on the base voltage on Q3 drops turning Q3 off. The automobile battery now drives the motor 60 through the 1k resistor R5 instead of the 1 ohm resistor R6. The current through the motor 60 drops to a point where the motor no longer rotates. This state continues until the user toggles the switch SW1 back to its center off position.

As an alternative and preferred embodiment, a magnet 98 is located in the flange **66*b* adjacent a Hall-effect transducer 99 and associated circuitry 100 that replaces the switch circuit 89. The Hall-effect switch senses rotation of the magnet 98** which rotates in excess of 20 revolutions per second when the motor is extending or retracting the antenna.

Two inputs M1, M2 to the circuit 100 (FIG. 5) are motor inputs which drive the motor in one of two directions depending upon the polarity of two inputs IP-1, IP-2 from a switch SW2. The switch SW2 is a double throw, double pole switch whose polarity is controlled by a relay (not shown) having a holding coil energized through the radio. When the coil is de-energized the switch polarity retracts the antenna and when the coil is energized the polarity is switched to extend the antenna. Thus, the antenna will extend automatically whenever the ignition and radio are both activated and will retract when either the radio or the ignition is switched off. In this embodiment the motor 60 is also energized by the car battery (not shown) so the retraction of the antenna is accomplished even though the ignition is switched off.

Assume a positive input at IP-1 which is transmitted through a diode and capacitor C2 to a base input of an NPN transistor Q-2, turning that transistor on. This in turn turns on one of the two power transistors Q-3, Q-4 to the right of FIG. 5. When IP-1 is positive it is seen that a diode between IP-1 and the emitter of Q-3 conducts so that transistor Q-2 turns on power transistor Q-3. Alternately when IP-1 is negative, capacitor C3 turns on Q-2 which turns on Q-4 and the direction of current flow through the motor is reversed. Thus, whenever the transistor Q-2 conducts, one or the other of the power transistors Q-3 or Q-4 is biased into conduction by a signal at the base of that power transistor so that the application of either polarity signal at IP-1 and IP-2 energizes the motor 60.

The signal applied to IP-1 and IP-2 is a DC signal so that after the initial receipt of that signal the two capacitors C-2 and C-3 will block the transmission of those signals to the base of the transistor Q-2. Thus, but for the presence of the Hall-effect transducer 99 and a fourth transistor Q-1, the motor would receive a signal temporarily and once the blocking effect of C-2 and C-3 take effect, motor rotation would terminate.

Figure 5:
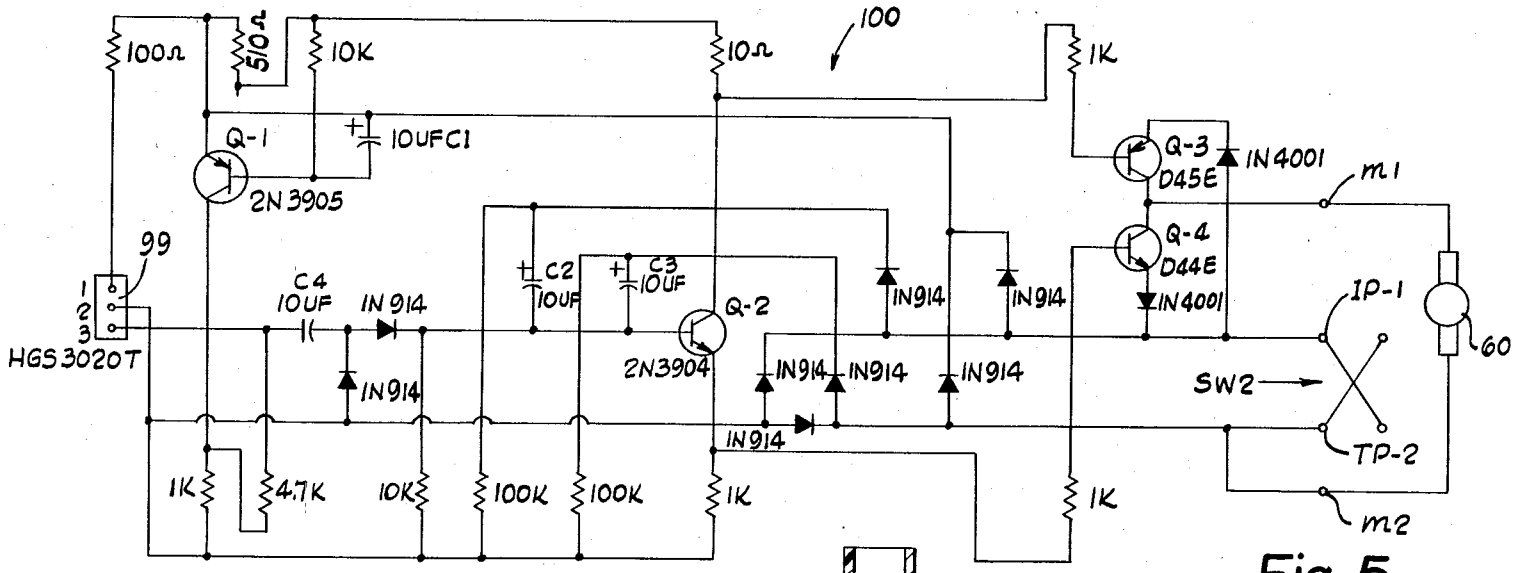
FIG. 5 is a schematic of an alternate and preferred control circuit for operating the motor.

Once rotation of the motor begins, however, the Hall-effect transducer 99 senses magnet rotation and generates pulses at its terminal labeled #3 in FIG. 5. These pulses are coupled through a capacitor C-4 and a diode to the base of the transistor Q-2. Periodic receipt of this pulse continues to bias transistor Q-2 into conduction which in turn keeps one power transistor (Q3 or Q4) turned on maintaining the motor drive signals at M-1 and M-2. In the event the motor drive action moves the antenna to one of its limits of travel, continued movement is no longer possible and the Hall transducer no longer generates these pulses. Once these pulses stop the transistor Q-2 also ceases to conduct since its base emitter junction no longer has the necessary voltage across it and for a similar reason the power transistor (either Q-3 or Q-4) also stops conducting.

A transistor Q-1 insures that the alternating pulses appearing at the base of the transistor Q-2 are generated from movement of the antenna drive and not from spurious vibrations in the car fender. The same input from either IP-1 or IP-2 which initially biases transistor Q-2 into conduction appears at the base of transistor Q-1 to cause conduction in that transistor. This transistor will continue to conduct until transistor Q-2 turns off at which time transistor Q-1 also turns off disabling the Hall-effect transducer. Thus, the Hall-effect transducer is only capable of transmitting pulses when transistor Q-1 conducts and this transistor in turn can only conduct when an input appears at either IP-1 or IP-2. Once the end of travel has been reached and the transistor Q-1 is turned off, spurious vibrations to the Hall-effect transducer will never reinitiate conduction in transistor Q-2 without the appearance of the signal at IP-1 or IP-2.

In summary, as long as the antenna is extending or retracting through hub rotation, either transistor Q-3 or Q-4 conducts; but upon reaching the end of travel or an obstruction, stopping the hub rotation, the conducting transistor turns off, automatically disrupting power to the motor drive. When the car radio is turned off, the inputs IP-1 and IP-2 are reversed to reverse current direction through the motor and the Hall-effect transducer generates pulses causing the motor to retract the antenna by driving the hub in the opposite direction until the antenna is fully retracted or movement is obstructed.

The circuit 100 (FIG. 5) is preferable to the circuit 89 (FIG. 4) since the user need not deactivate the circuit 100 after the motor 60 has fully extended or retracted the antenna. After the car ignition is turned off, IP-1 and IP-2 are still coupled to the battery by the switch SW2 but when all transistors are turned off the circuit 100 draws only about 3 milliamps, a current the battery can supply for over 3000 hours without any problem.

The Hall-effect transducer can be replaced with other means for generating a pulse train to maintain the transistor Q-2 conductive. An optical sensor might be mounted in close proximity to the flange **66*b* to sense rotation of a mark or irregularity in the flange. The irregularity might comprise, for example, castellations or slots in the flange 66*b* which would preferably trigger the optical sensor. Such an optical sensor would include an infrared radiation source which would be insensitive to dirt build-up in the vicinity of the flange 66*b***.

In a preferred embodiment of the housing 12, the length L (FIG. 1) is 2.84 inches and the height H is 3.75 inches. The width W (FIG. 2) is 1.20 inches and the diameter D of the supporting tube 14 is 0.8 inch. Thus, in the preferred embodiment the housing width has been kept to no more than 1.5 times greater than the width of the supporting tube and the length no more than 3.6 times greater. The over all height of the housing and antenna, except for the storage tube 22, with the antenna collapsed, is 12.4 inches. The weight of the preferred embodiment is 15.9 ounces, which is sufficiently light to permit mounting with top hardware (i.e., a bracket or the like at the top of the supporting tube 14) only. The small size of the housing occupies an extremely small volume within a wheel well of the vehicle, which is highly desirable to the automobile manufacturer. It will be apparent from FIG. 3 that the housing construction, the drive transmission construction and arrangement, and the use of the housing piece 30 as a part of the motor structure, all combine to provide the extreme compactness and light weight. This is contributed to by the use of a timing belt 78 and plastic pulley wheels, in lieu of a drive train of gears, which would require additional elements, supports, and weight.

While preferred embodiments of the invention have been described in detail, various modifications or alterations may be made therein without departing from the spirit and scope of the invention set forth in the appended claims.

We claim:

1. Antenna structure adapted for mounting to a vehicle mounting surface comprising an outer fixed antenna tube having an end adapted to extend through an opening in said mounting surface, a number of telescoping antenna sections collapsible within the outer tube which together form an antenna unit slidably removable from the outer tube, a reversible electric motor located adjacent the tube having an output shaft, a transmission coupled between said output shaft and the antenna sections to extend and retract sections through the opening relative to said outer tube, a housing for said motor and transmission, a mounting member coupled to the housing and adapted to be secured to the vehicle mounting surface, a first tubular insulator abutting said mounting member and surrounding said antenna tube between the tube and mounting member and a retaining collar couplable to said tube and insulator for limiting the extent of movement of said antenna sections relative to said tube, said collar being removable to allow said antenna unit to be withdrawn from said tube and replaced.

2. The structure of claim 1 wherein said retaining collar has an internal thread coupled to an external thread on said end of said tube.

3. The antenna structure of claim 1 additionally comprising means for adjusting the position of the tube within the first insulator when the antenna structure is first mounted to the vehicle mounting surface.

4. The antenna structure of claim 3 additionally comprising a second tubular insulator attached to the outer tube and wherein said means for adjusting comprises a seal compressible between the second tubular insulator and said transmission and a connector extending through the housing, tube and second insulator to hold said second insulator in place against the compressible seal.

5. Antenna structure comprising an outer fixed antenna tube, a number of telescoping antenna sections collapsible within the outer tube which together form an antenna unit slidably removable from the outer tube, a reversible electric motor located adjacent the tube having an output shaft, a transmission coupled between the output shaft and the antenna sections to extend and retract sections relative to said outer tube, said transmission comprising a flexible cord with threaded portions peripherally separated about said cord by flattened opposed surfaces, said cord connected to said antenna unit for extending and retracting said collapsible sections, and a driven nut that includes a threaded internal bore, which engages said threaded cord so that rotation of said nut moves said cord and said antenna sections, said antenna structure further comprising a tubular plastic insulator attached to said outer tube, said tubular insulator defining a center passageway through which said flexible cord extends, said passageway having flattened side walls that engage the flattened surfaces of said cord to inhibit rotation of said cord, a housing for said motor and transmission, and means couplable to said tube for limiting the extent of movement of said antenna sections relative to said tube, said means being removable to allow said antenna unit to be withdrawn from said tube and replaced.

6. The antenna structure of claim 5 further comprising a compressible seal between said tubular plastic insulator and said rotary nut.

7. The structure of claim 6 wherein said seal comprises an O-ring which circumscribes said cord between the tubular insulator and nut and allows relative rotation of said nut with respect to said tubular insulator.

8. The structure of claim 6 including means fixing the outer tube in relation to said mounting surface and housing, said means including a threaded connector extending through said housing and said tube into said tubular plastic insulator to hold said insulator in place against said seal.

9. Antenna structure comprising an outer fixed antenna tube having an end adapted to extend through an opening in an antenna mounting surface, a number of telescoping antenna sections collapsible within the outer tube which together form an antenna unit slidably removable from the outer tube, a reversible electric motor located adjacent the tube having an output shaft, a transmission coupled between said output shaft and the antenna sections to extend and retract sections relative to said outer tube, a housing for said motor and transmission, a first insulator closely and slidably surrounding said antenna tube adjacent said extending end, held in fixed relationship with respect to said housing, and a retaining collar having an internal thread coupled to an external thread on said end of the antenna tube and further having a portion adapted to tightly abut an end of said first insulator, said tube being longitudinally adjustable relative to the housing and first insulator to facilitate abutting the collar portion against the antenna tube end.

10. The structure of claim 9 wherein said tube is attached at one end to a second insulator received in said housing, and including a compressible seal located between said second insulator and the housing that facilitates longitudinal adjustment of said tube while maintaining a seal between the second insulator and the housing.

* * * * *